US005372003A

United States Patent [19]

Stahlecker

[11] Patent Number: 5,372,003

[45] Date of Patent: Dec. 13, 1994

[54] SPINNING MACHINE

[75] Inventor: Fritz Stahlecker, Bad Überkingen, Germany

[73] Assignee: Hans Stahlecker, Germany; a part interest

[21] Appl. No.: 167,127

[22] Filed: Dec. 16, 1993

Related U.S. Application Data

[63] Continuation of Ser. No. 847,687, Mar. 6, 1992, abandoned.

[30] Foreign Application Priority Data

Mar. 20, 1991 [DE] Germany ..... 4109096

[51] Int. Cl.[5] ..... D01H 13/04

[52] U.S. Cl. ..... 57/90; 57/315; 242/171

[58] Field of Search ..... 57/90, 315; 226/170, 226/171

[56] References Cited

U.S. PATENT DOCUMENTS

| | | | |
|---|---|---|---|
| 6,794 | 10/1831 | Treadwell | 57/315 |
| 355,870 | 1/1887 | Good | 57/90 |
| 2,454,323 | 11/1948 | Jackson | 57/315 |
| 2,598,451 | 5/1952 | Simpson | 226/171 X |
| 2,706,377 | 4/1955 | Slayter | 57/315 |
| 3,063,231 | 11/1962 | Livingston | 57/90 |
| 3,312,050 | 4/1967 | Noguera | 57/90 |
| 3,371,388 | 3/1968 | Dillies | 57/90 X |
| 4,208,000 | 6/1980 | Drummond | 226/171 |
| 4,355,749 | 10/1982 | Wülfing et al. | 57/90 X |

FOREIGN PATENT DOCUMENTS

| | | | |
|---|---|---|---|
| 817572 | 10/1951 | Germany . | |
| 2335740 | 11/1974 | Germany . | |
| 221423 | 9/1990 | Japan | 57/315 |
| 7016184 | 5/1971 | Netherlands | 57/315 |

*Primary Examiner*—Joseph J. Hail, III
*Attorney, Agent, or Firm*—Evenson, McKeown, Edwards & Lenahan

[57] ABSTRACT

In the case of a spinning machine for the spinning of yarns from slivers with a can feeding, the slivers are transported from the cans to the spinning stations by a belt which is provided with holding elements which hold the sliver on its surface. The holding elements may comprise surfaces which guide the sliver laterally by a frictional engagement or may have devices so that the sliver adheres with its supporting surface to the belt. Advantageously, two slivers are transported by one belt.

28 Claims, 9 Drawing Sheets

Fig.18
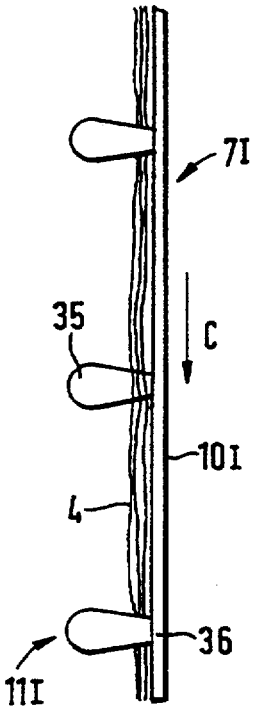
Fig.19
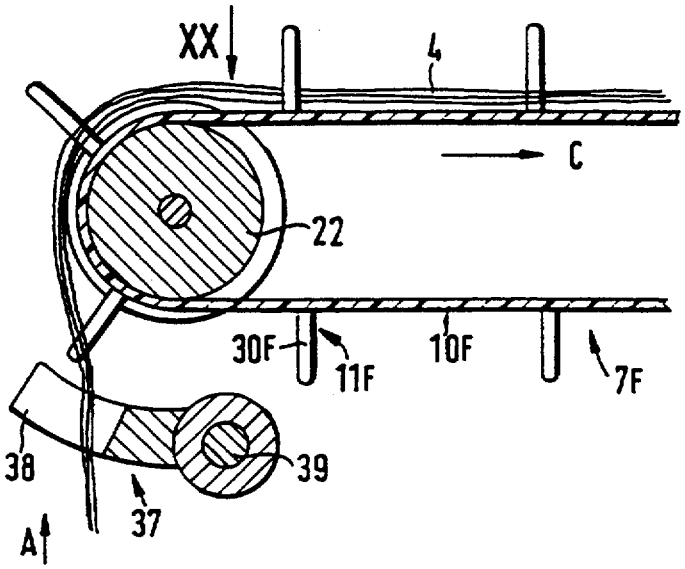
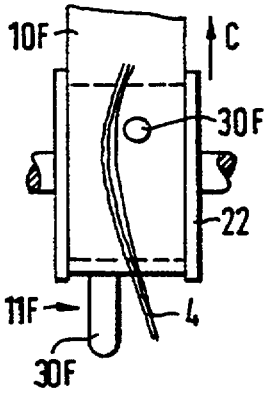
Fig.20
Fig.21
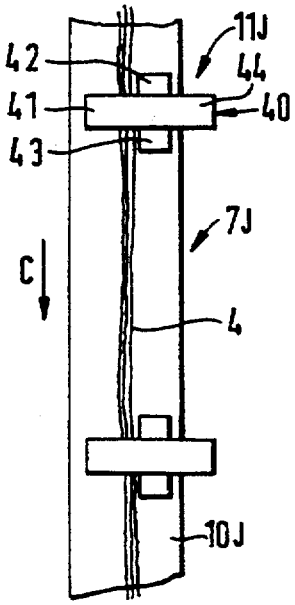
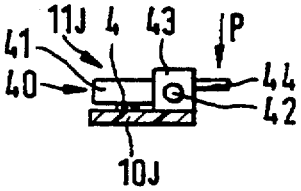
Fig.22

51
51
55
54
52
8K
H
K
4
7K
7K'
9K
5
45
46
47
48
C
48'
47'
6
49
49'
50
53
3K
2
2K'
3K'
1K

Fig.31
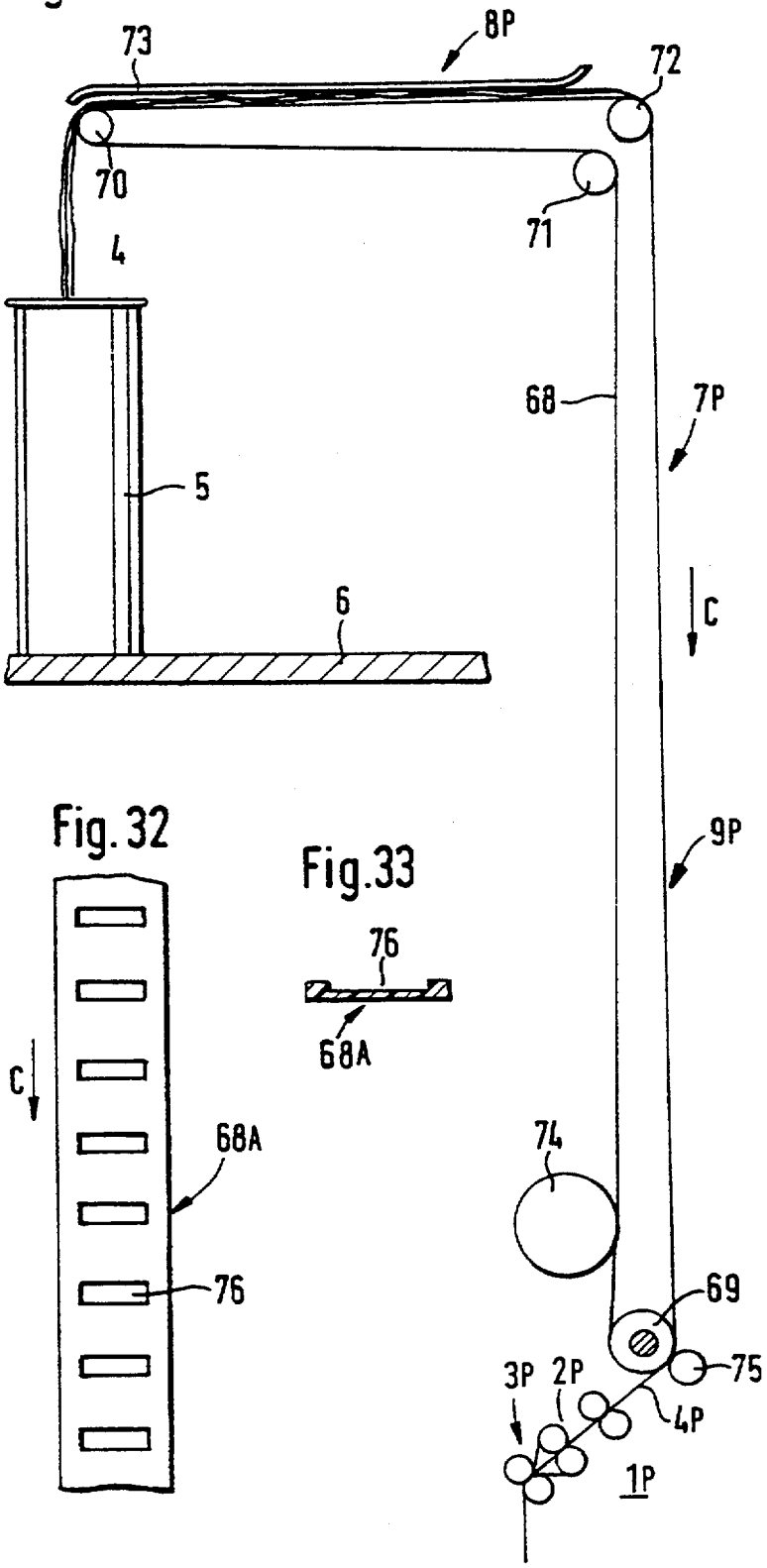
Fig.34
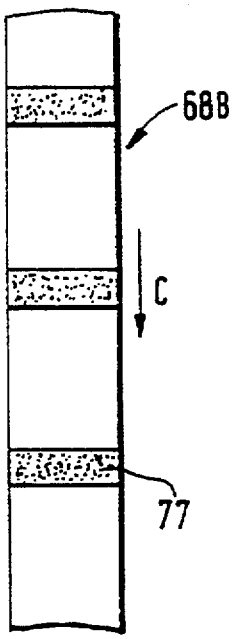
Fig.32
Fig.33
Fig.35
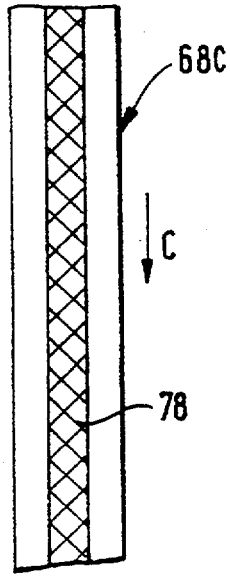

Fig.36
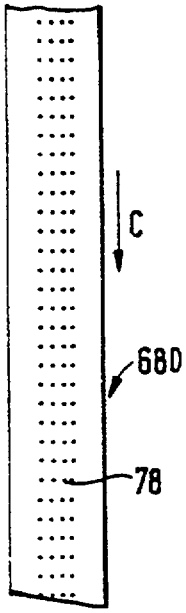
Fig.37
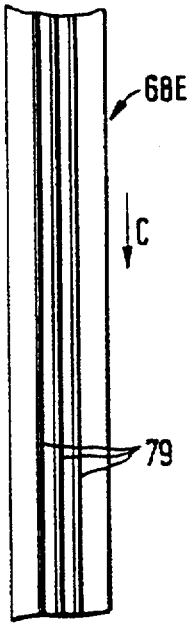
Fig.38
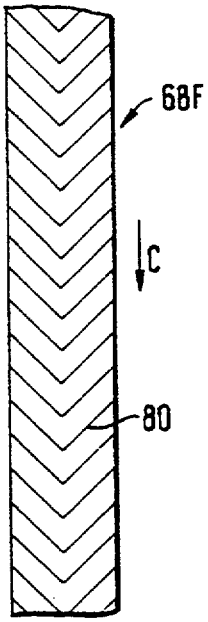
Fig.39
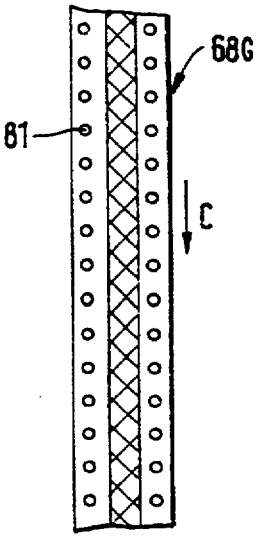
Fig.40
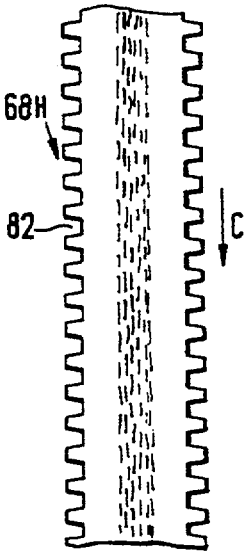
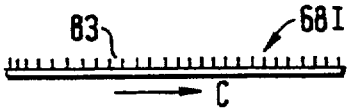
Fig.41
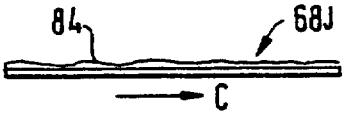
Fig.42
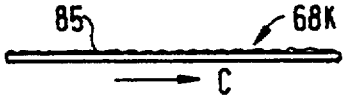
Fig.43
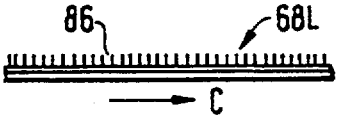
Fig.44
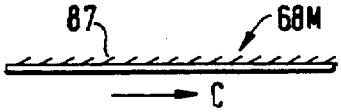
Fig.45
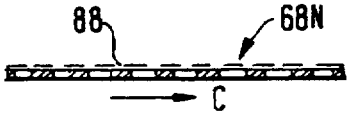
Fig.46

SPINNING MACHINE

This application is a continuation of application Ser. No. 07/847 687 filed on Mar. 6, 1992 now abandoned.

BACKGROUND AND SUMMARY OF THE INVENTION

The invention relates to a spinning machine having several spinning stations for the spinning of yarns from slivers which are fed to the spinning stations in cans, guiding devices for the slivers being provided between the cans and the spinning stations.

The feeding of the fiber material to be spun in the form of slivers disposed in cans is known, for example, in the case of open-end spinning machines. In the case of the machines which are available on the market, the slivers are withdrawn directly by the sliver feeding device of the individual spinning stations from the cans disposed in front of and partly below the spinning arrangement.

It is also known (German Patent Document DE-C 23 35 740), in the case of open-end spinning machines, to arrange the cans on a platform above the spinning machine and feed the slivers through guiding tubes to the spinning stations. These guiding tubes, which are provided with baffles, are to serve as an intermediate storage device which, on the basis of a special construction, is fed by a continuously running feeding device nevertheless intermittently. Then the sliver is to be guided through the respective guiding tube essentially without tensile stress.

The feeding of the fiber material in the form of slivers made available in cans is also known in the case of other fast-running spinning machines, such as wind-around spinning machines or air spinning machines. As a rule, these are one-sided machines, in the case of which the slivers withdrawn from the cans deposited on the rear side of the spinning machine are fed to the spinning stations from above. In this case, guiding devices for the slivers are provided in the form of pulleys and guide rods.

It is also known (German Patent Document DE-PS 817 572) to feed slivers in cans in the case of ring spinning machines, in which case the cans are deposited on platforms or in a space above the spinning machine. In this case, relatively long travelling paths are obtained with one or several vertical runs which lead to the risk that the slivers may hang out; that is, are drafted uncontrollably as a result of their own weight. Such an arrangement is therefore possible only for slivers which have a relatively coarse size and thus a relatively high strength.

However, the spinning of slivers of coarse sizes is very difficult on ring spinning machines. Since the ring spinning machines have only a relatively low delivery speed at the outlet of the drafting units, the feeding rollers of the drafting units—while the required drafting is taken into account—must run very slowly; that is, at rotational speeds of one revolution per minute and less. It is technically extremely difficult to let long shafts such as for the feeding rollers of drafting units, run at such low rotational speeds with sufficient precision. There is the risk that these shafts will rotate only jerkily so that no controlled draft is obtained. The feeding of the fiber material to be spun in cans has therefore not been carried out successfully in practice in the case of ring spinning machines.

In an older German Patent Application (P 40 41 112.5, PA 1170, P 9342), corresponding to U.S. application Ser. No. 07/809,141, filed Dec. 18, 1991, now abandoned in favor of U.S. continuation-in-part application Ser. No. 07/948,638, filed Sep. 23, 1992, which is no prior publication, it is suggested to provide guiding devices which comprise a transport belt which is provided with a mounting of needles which project toward the outside. The needles, which are arranged at relatively large distances of, for example 10 cm, are sloped toward the rear against the moving direction. By means of these needles, which pierce the sliver, the sliver is supported in the vertical direction.

It is an object of the invention to develop a spinning machine of the initially mentioned type in such a manner that fine slivers may also be fed in cans without the risk of faulty drafts, particularly in vertical portions of the transport path.

This object is achieved according to preferred embodiments of the invention in that the guiding devices comprise one belt respectively which transports the pertaining sliver and is equipped with holding elements which hold the sliver on its surface.

In the case of certain preferred embodiments according to the invention, it is achieved that the slivers are supported and are nevertheless moved in the transport direction. As a result, it is possible to feed also relatively thin slivers in cans; that is, slivers of sizes of approximately Nm 0.4 to 0.8. In this case, these fine slivers may also be transported in the vertical direction along larger travel paths. It is therefore possible to carry out a can feeding also in the case of ring spinning machines because, on the basis of the slivers with the fine sizes, while taking into account the draft, the feeding roller pairs of the drafting units still run at a sufficiently high speed so that a uniform circumferential rotating speed is ensured. By means of this can feeding, it will then be possible in the case of ring spinning machines to do without a premounted machine, specifically the flyer. In the case of other spinning machines, which are equipped with drafting units into which the slivers travel, it is possible to feed finer slivers so that then the drafting units may be simplified. For example, in the case of machines of this type, there is the possibility to use the three-cylinder drafting units which are customary today in the case of ring spinning machines, instead of five-cylinder drafting units.

Also in the case of open-end machines, the feeding of finer slivers results in advantages because then the opening-up work for the separating of the fibers is reduced so that, during the opening-up, the fibers are processed more carefully. It is therefore possible to spin finer yarns with less damaged fibers so that the yarns have a higher quality.

In contrast to the suggestion of the older patent application mentioned above, the sliver is mainly only held on its surface, for example, by lateral surfaces by means of a frictional engagement or on its supporting surface by means of adhesion to the belt. As a result, a damaging of the sliver is avoided.

Other objects, advantages and novel features of the present invention will become apparent from the following detailed description of the invention when considered in conjunction with the accompanying drawings.

BRIEF DESCRIPTION OF THE DRAWINGS

FIG. 18 is a view similar to FIG. 12 with a different design of the holding elements;

FIG. 19 is an enlarged representation of a partial view of FIG. 1 with a device for the inserting of the sliver on the belt;

FIG. 20 is a view in the direction of the arrow XX according to FIG. 19;

FIG. 21 is a view similar to FIG. 3, in which case the holding elements are constructed as clamping devices;

FIG. 22 is a view of FIG. 21 against the running direction of the belt;

FIG. 31 is a view similar to FIG. 1 with a belt developed as an adhesive band;

FIG. 32 is a view similar to FIG. 3 of the belt of FIG. 31;

FIG. 33 is a view similar to FIG. 4 of the belt of FIG. 32;

FIGS. 34 to 40 are further developments of the belt in a view according to FIG. 32;

FIGS. 41 to 46 are views of the belt similar to FIG. 2 with different holding elements;

DETAILED DESCRIPTION OF THE DRAWINGS

Figures 1, 2, 3:
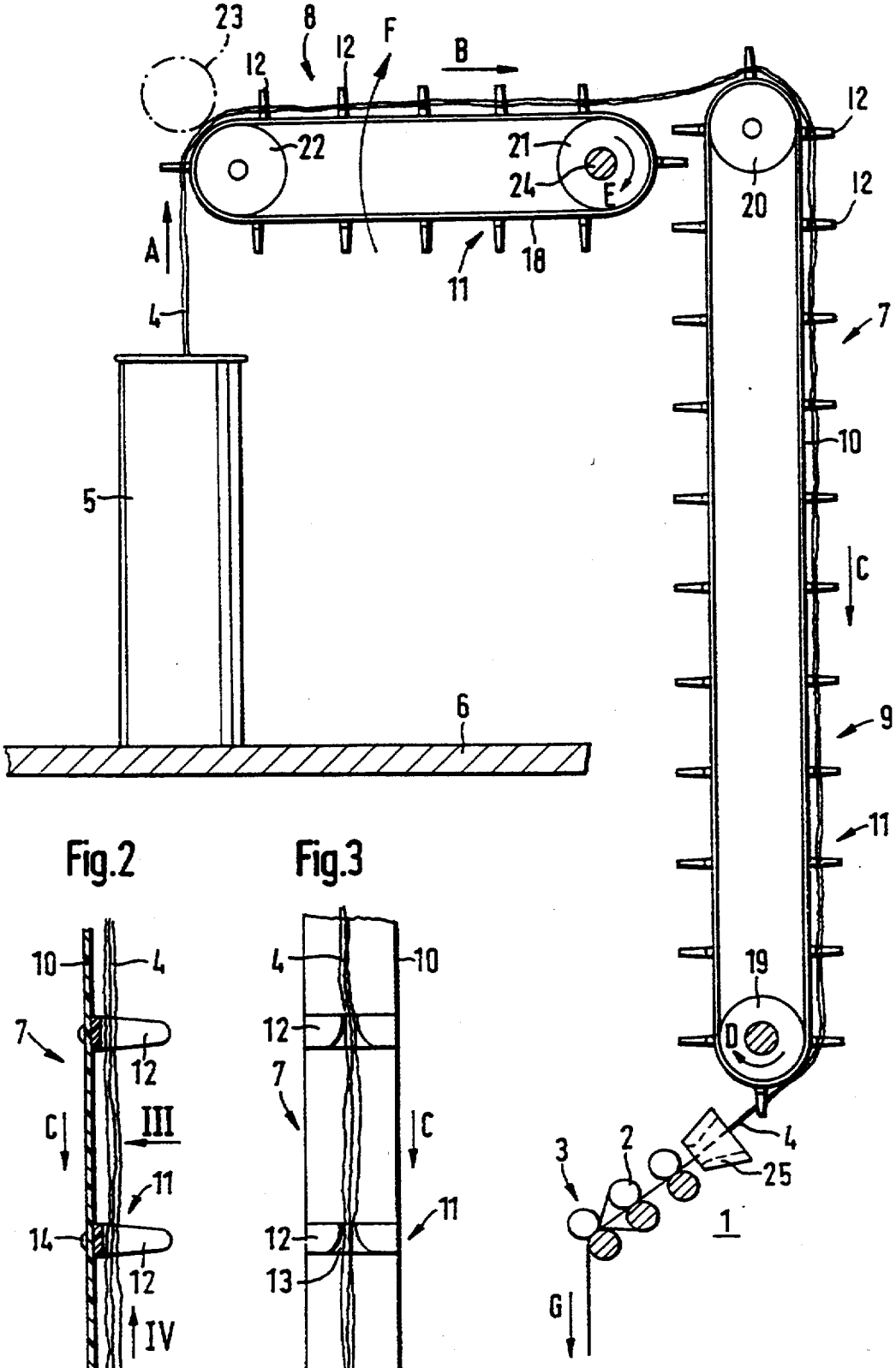
FIG. 1 is a partial cross-sectional view of a spinning machine constructed in accordance with a preferred embodiment of the invention, in which case only a drafting unit of one side of the machine is shown to which a sliver is fed from a can deposited on a platform, in which case the sliver is transported by a belt equipped with holding elements.
FIG. 2 is an enlarged representation of a partial view of FIG. 1 in the area of the holding elements.
FIG. 3 is a view in the direction of the arrow III of FIG. 2.

In FIG. 1, only one drafting unit 2 of an individual spinning station 3 is shown of a spinning machine 1. However, such a spinning machine 1 comprises a plurality of such spinning stations 3 which are arranged in a row next to one another on one side of the machine. A twist-providing machine, such as a ring spindle or a wind-around spindle or an air nozzle, which is not shown, connects to each drafting unit 2. Likewise, alternative embodiments are contemplated with a sliver feeding device of an open-end spinning machine arranged at the location of and in place of the drafting unit 2. At each of these spinning stations 3, a sliver 4 is withdrawn from a can 5 and spun into a yarn.

In the embodiment according to FIG. 1, the cans 5 of the individual spinning stations 3 are disposed above the spinning machine 1 on a platform 6. The cans 5, which normally have an outside diameter which is larger than the spacing of the spinning stations 3 (spacing of the spinning stations in the longitudinal direction of the machine) are deposited in several rows extending in the longitudinal direction of the spinning machine 1.

The slivers 4 are withdrawn in the direction of the arrow A upwards from the cans 5, which are open on top, and are then transported downwards to the drafting units 2. In order to securely bridge this path also in the case of fine sizes of the slivers 4 without the occurrence of faulty drafts in the fine slivers 4, special guiding devices 7 are provided.

The guiding devices 7 have a horizontal path 8 in which the sliver 4 is transported in the direction of the arrow B, as well as a vertical path 9, in which the sliver 4 is transported in the direction of the arrow G. The vertical path 9 is particularly critical with respect to the danger of faulty drafts in the sliver 4.

In the vertical path 9, the guiding devices 7 comprise a circulating belt 10 which is provided with spaced holding elements 11 which hold and guide the sliver 4. As shown more clearly in FIGS. 2 and 3, the holding elements 11 consist of sliver-guide-type holders 12 which are preferably made of plastic. They have a center indentation 13 which is widened in the shape of a funnel in the transport direction C' so that behind the can 5, the sliver 4 can easily be placed in the holding elements 11. A very slight adhesion of the sliver 4 in the holding elements 11 is sufficient.

As shown in FIG. 2, the holders 12 are mounted on the belt 10 by means of rivets 14. In the drawings and the following description, corresponding structural features are identified with similar reference numerals, with different embodiments designated with letter suffices. Certain structural features that are designated with different letter suffices, corresponding to the respective embodiment, and which are not separately referred to in the specification are to be considered as similar to other similarly numbered features in other embodiments.

Figure 4:
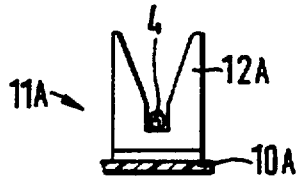
FIGS. 4 is a view of a holding element similar to FIG. 2 in the direction of the arrow IV of FIG. 2.
Figure 5:
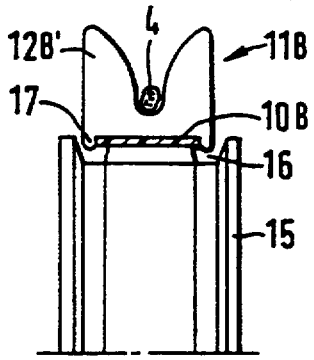
FIG. 5 is a view of another holding element similar to FIG. 4 in the area of a deflection pulley.

As an alternative according to FIG. 4, the holders 12A of the holding elements 11A may be glued to the belt 10A. According to the alternative of FIG. 5, the holders 12B may be snap fitted onto the belt 10B*b*. In this case, possible guiding rollers 15 must be provided with recesses 16 in the area of the snap connection 17.

According to FIG. 1, the vertical path 9 has a separate belt 10 in front of which a separate belt 18 may also be arranged in the horizontal path 8 which is provided with the same holding elements 11. The vertical belt 10 is guided by two pulleys 19 and 20 arranged above one another, of which pulley 19 is constructed as a driving pulley and rotates in the direction of the arrow D. The horizontal belt 18 is guided around two pulleys 21 and 22, of which pulley 21 is constructed as the driving pulley and rotates in the direction of the arrow E.

Pulley 22 is arranged at a narrow distance above the pertaining can 5, in which case a pulley 23, which is indicated by a dash-dotted line, is assigned to pulley 22. The function of pulley 23 will be described below by means of FIGS. 6 and 7. For servicing purposes, pulley 22 and thus belt 18 can be swivelled upward about the axis 24 of the driving pulley 21 in the direction of the arrow F.

A feeding hopper 25 is provided between the driving pulley 19 of the vertical belt 10 and the drafting unit 2. Behind the drafting unit 2, the drafted sliver 4 is guided in the direction of the arrow G to a twist-providing element which is not shown, such as a ring spindle or a wind-around spindle.

Figure 6:
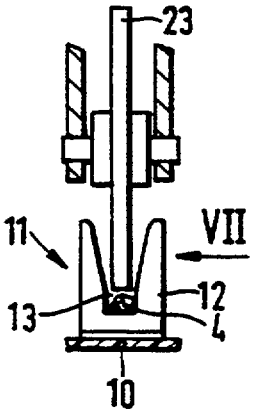
FIG. 6 is a view of a device for the inserting of the sliver into a holding element.
Figure 7:
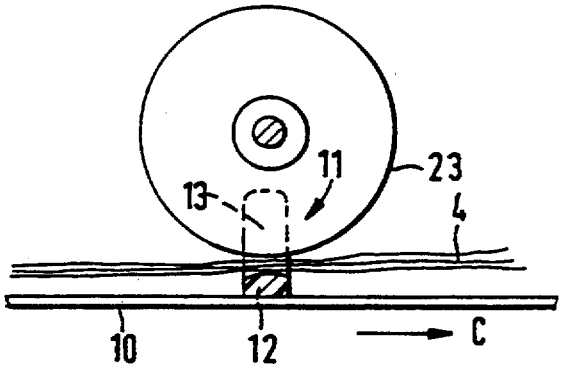
FIG. 7 is a partially sectional view in the direction of the arrow VII of FIG. 6.

In a representation that is enlarged in FIGS. 6 and 7, FIG. 1 shows the pulley 23 which is constructed as a small pressure wheel and has the purpose of pressing the sliver 4 into the holder 12. The pulley 23 must ensure that the sliver 4 is situated completely on the base of the clear recess 13 of the holder 12. It is rolled into the holders 12.

Figure 8:
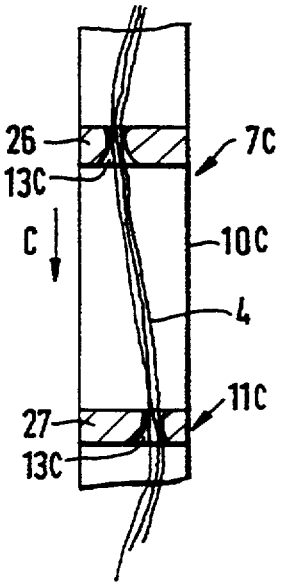
FIG. 8 a view similar to FIG. 3 with holding elements which cause a serpentine-type course of the sliver.

The belt 10C of the guiding device 7 according to FIG. 8 exhibits a variant in which two clamp-type holders 26 and 27 form the holding elements 11C, where the clear recess 13C, in one case, is arranged on the left side and, in the other case, on the right side in such a manner that the sliver 4 is guided in the shape of a serpentine. As a result, a slight lateral contact pressure onto the sliver 4 is achieved so that the frictional engagement becomes more secure.

Figure 10:
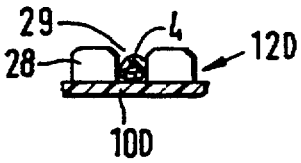
FIG. 10 is a view in the direction of the arrow X of FIG. 9.
Figure 9:
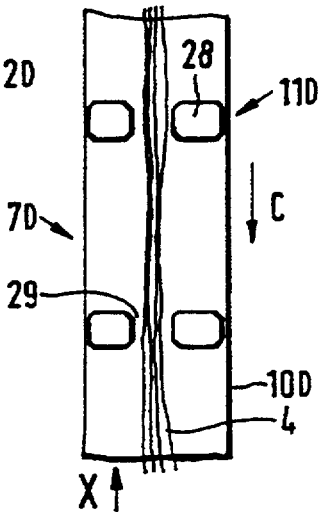
FIG. 9 is a representation similar to FIG. 3 with cam-type holding elements.

The construction according to FIGS. 9 and 10 shows a belt 10D of the guiding device 7D on which humps 28 are placed as the holding elements 11D. A gap 29 exists between each of them into which the sliver 4 is placed by means of the already described pulley 23. The lateral friction between the two humps 28 is sufficient for securing the sliver 4 on the belt 10D. Two humps 28 respectively, which are assigned to one another, are arranged at a distance from one another in the transport direction C of the belt 10D.

Figure 11:
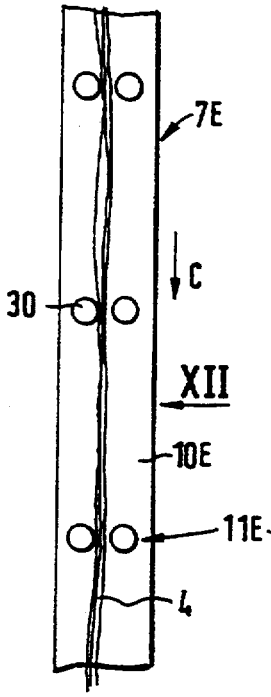
FIG. 11 is a view similar to FIG. 3 with pin-type holding elements.
Figure 12:
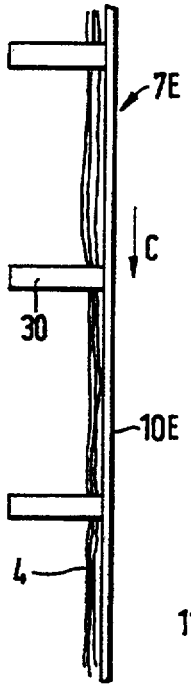
FIG. 12 is a view in the direction of the arrow XII of FIG. 11.
Figure 13:
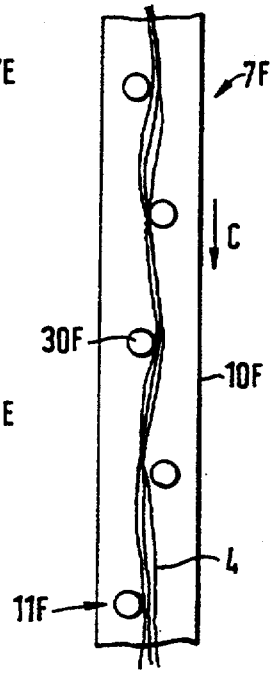
FIGS. 13 to 15 are additional views similar to FIG. 3 with differently designed holding elements.
Figure 14:
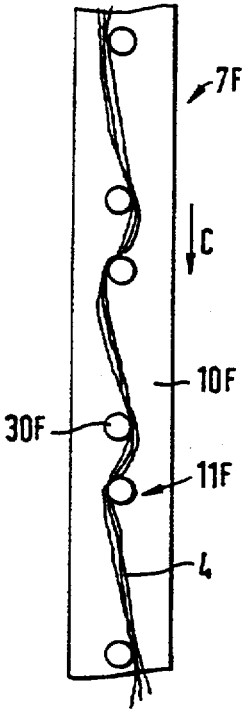
Figure 15:
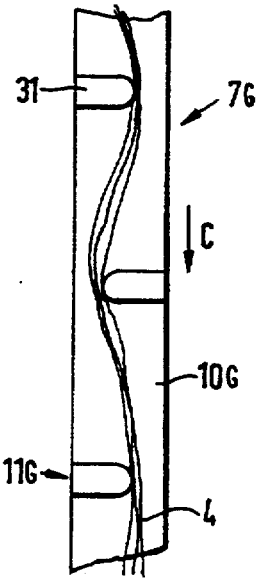
Figure 16A:
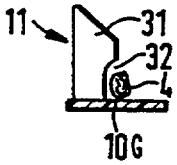
FIGS. 16A, 16B, 17A and 17B are views similar to FIG. 4 with differently designed holding elements which permit a serpentine-type course of the sliver according to FIG. 8.
Figure 17A:
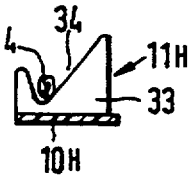
Figure 16B:
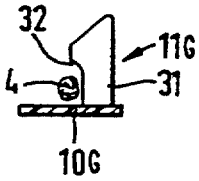
Figure 17B:
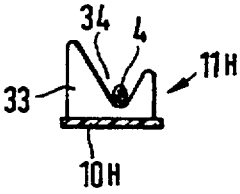

A similar construction is illustrated in FIGS. 11 and 12, in which case two small cylindrical pins 30 respectively are mounted on the belt 10 as the holding elements 11. They either stand closely next to one another in pairs, as shown in FIG. 11, or are slightly offset behind one another, as shown in FIGS. 13 and 14, suffices "F" inserted for the pins 30F, belt 10F, and holding elements 11F. Also in these cases, the sliver 4 is secured by the holding elements 11E, 11F by lateral frictional adhesion. Instead of the pins 30, 30F, the holding devices 11G may be formed by blocks 31 which, according to FIG. 15, again force a serpentine-like course onto the sliver 4 and, as a result, laterally secure the sliver 4 by frictional engagement. According to FIGS. 16A and 16B, these blocks 31 may be designed such that a recess 32 exists for the sliver 4 in the lower area of the blocks 31. However, as an alternative according to FIGS. 17A and 17B, blocks 33 may be used which are mutually arranged such that a clear recess 34 again forces the sliver 4 to perform a serpentine-like movement, in which case, however, the sliver 4 is laterally guided toward both sides.

Finally, according to FIG. 18, the holding elements may be designed as stoppers 35 which, in the area of the fastening point 36 to the belt 10I, are slightly constricted. As a result, it is, particularly in the vertical run 9 of its transport path, made difficult for the sliver 4 to move away from the belt 10I.

FIGS. 19 and 20 show the guiding device 7 in the area of the deflection pulley 22 already described by means of FIG. 1. When the pins 30F, as illustrated in FIGS. 13 and 14, force the sliver 4 to perform a serpentine-like course, it is expedient to assign a device 37 to the guiding devices 7F which is capable of inserting the sliver 4 between the holding elements 11F. This device 37 is constructed as a rake which comprises two fork-type prongs 38 which receive the sliver 4 between one another. The rake may traverse transversely to the belt 10F so that the sliver 4 comes to rest on the belt 10F in the slalom position indicated in FIG. 20. In this case, the device 37 traverses slightly on the shaft 39, in which case the drive for the traversing movement is not shown.

In the embodiment according to FIGS. 21 and 22, the holding elements 11J of the guiding device 7J are constructed as clamping devices 40. They comprise a small lever 41 which can be folded open about a pin 42. The pin 42 is held in a small bearing block 43 which, in turn, is laterally fastened to the belt 10J. By pressure in the direction of the arrow P onto the pusher 44 which forms one piece with the lever 41 but projects toward the other side of the pin 42, the clamping device 40 may be opened. This takes place by devices, which are not shown, in the area of the deflection pulley 22 (see FIG. 1) so that the sliver 4 can be placed in the clamping device 40. The operating of the pusher 44 may take place in such a manner that the belt 10J is made to travel along a molded rail by which the pusher 44 is actuated. This can take place, for example, by way of a dead-center spring, in the case of which, even at a low pressure, the clamping device 40 is opened up and remains in this position until the pusher 44 is actuated again in the opposite direction.

Figure 23:
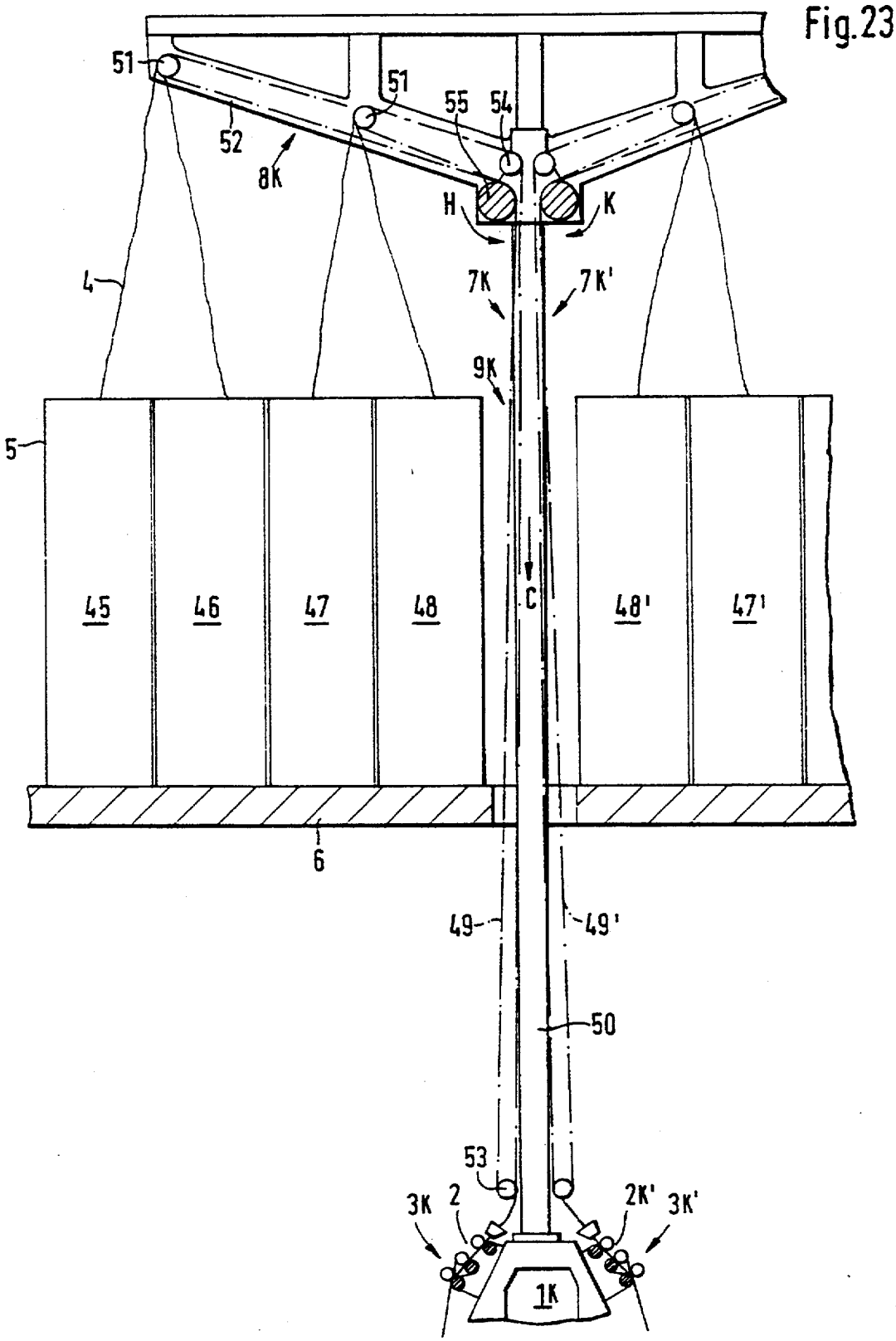
FIG. 23 is a partial cross-sectional view similar to FIG. 1 with a differently constructed belt, in which case four rows of cans are provided for each side of the machine.

In the embodiment according to FIG. 23, a spinning machine 1K is outlined which comprises spinning stations 3K and 3K' arranged next to one another on each side of the machine. Of these spinning stations 3K, 3K' only one drafting unit 2K or 2K' respectively is recognizable. For each side of the machine, there are four rows 45, 46, 47 and 48 of cans 5 which are deposited above the spinning machine 1K on a platform 6. On the right-hand side, two rows 47' and 48' of cans 5 can also still be recognized. A space exists between the rows 48 and 48' through which the guiding device 7K or 7K' of the respective side of the machine can be guided. The platform 6 is also interrupted here.

As will be described below by means of FIGS. 24 to 28, the guiding device 7K, in this embodiment, has a toothed belt 49 or 49'. In a manner that is not shown, the toothed belt 49 or 49' may be combined with a sliding band, as explained, for example, in the above-mentioned older Patent Application P 40 41 112.5.

In each case, the guiding devices 7K, 7K' again comprise a vertical path 9K as well as a path 8K that is essentially horizontal but is slightly sloped in the transport direction. In the present case, the toothed belt 49 or 49' runs along the essentially horizontal path 8K as well as along the vertical path.

For the holding of the toothed belts 49, 49' as well as of its various deflection pulleys, which will still be described in detail, a so-called creel mast 50 is used which is supported on the spinning machine 1K. Above the cans 5, one deflection pulley respectively 51 is provided for each toothed belt 49 and 49' and is constructed as a tension pulley which is pivotally mounted on an arm 52 of the creel mast 50. Apart from these deflection pulleys 51, additional deflection pulleys 53 exist for each toothed belt 49 and 49' in the area of the spinning stations 3K, 37'. Finally, at the transition from the essentially horizontal path 8K to the vertical path, the toothed belt 49 and 49' is deflected by a deflection pulley 54 and by a driving pulley 55 constructed as a corner pulley. The function of this corner pulley 55 will be described in the following by means of FIG. 25.

As indicated, the deflection pulleys 51 are situated higher than deflection pulley 54 or corner pulley 55. The resulting diagonal course of the toothed belt 49 of the essentially horizontal path 8 is advantageous, particularly also because it does not limit the freedom of movement of the operating personnel in the area of the deflection pulleys 51, and nevertheless, the other deflection pulleys 54 and 55 can also conveniently be reached by hand.

As will be explained later, the corner pulleys 55 constructed as the deflection pulleys are driven in the direction of the arrows H and K so that the toothed belts 49, 49' receive the transport direction C. As a result, the sliver 4 is securely guided from the cans 5 to the drafting units 2K, 2K' of the spinning stations 3K, 3K'.

Figure 24:
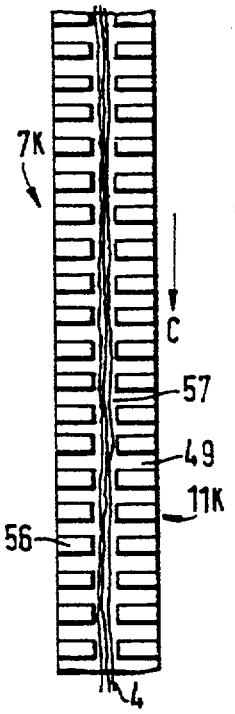
FIG. 24 is a view similar to FIG. 3 for the belt of FIG. 23.

The representation according to FIG. 24 shows that the toothed belt 49 of the guiding devices 7K comprises holding devices 11K which are constructed as edged tooth pieces 56. They may possibly be slightly offset against one another or may be arranged to fill gaps. The tooth pieces 56 form a channel 57 between one another in which the sliver 4 travels and, as a result, is laterally guided by the tooth pieces 56. Similar to the construction according to FIGS. 1, 6 and 7, the sliver 4 may, in this case, be rolled into the channel 57. The tooth pieces 56 may be constructed according to FIG. 26 or may have tooth pieces 58 according to FIG. 27 which still hang together and contain an indentation 59 between one another.

Figure 25:
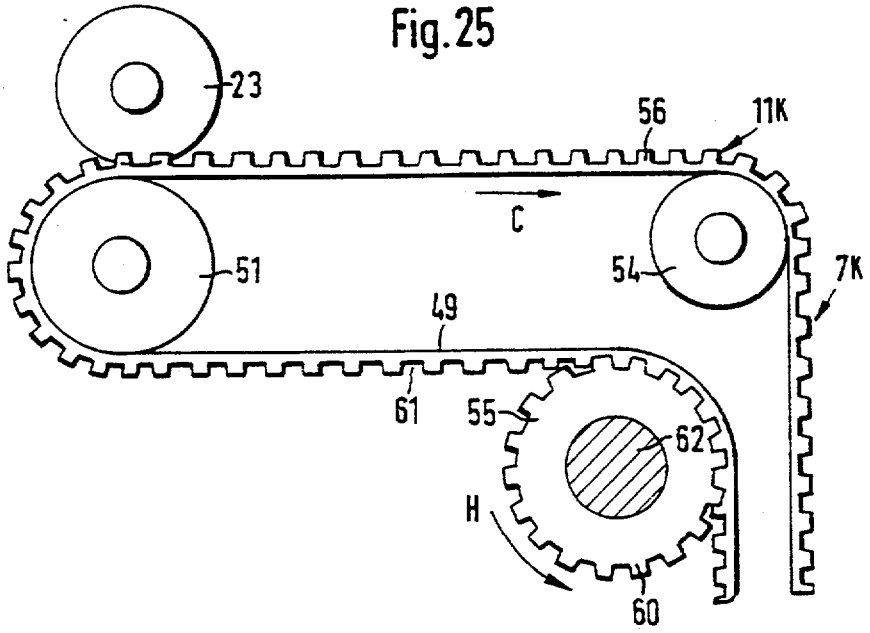
FIG. 25 is an enlarged representation of a partial view of FIG. 23 in the area of the driving pulley of the belt.
Figure 26:
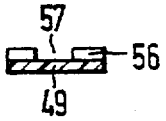
FIG. 26 is a view similar to FIG. 10 of the belt according to FIG. 24.

In an enlarged representation, FIG. 25 shows the toothed belt 49 in the area of the tension pulley 51, of the deflection pulley 54 as well as of the corner pulley 55 driven in the direction of the arrow H. In addition, the pulley 23 is outlined which rolls the sliver 4 into the duct 57. As demonstrated, the arrangement of the pulley 55 as the driving pulley has the advantage that the tooth pieces 56 not only guide the sliver 4 laterally by frictional engagement but at the same time also permit a formlocking drive of the toothed belt 49 because of the fact that teeth 60 of the corner pulley 55 can engage in the tooth gaps 61 of the toothed belt 49. The corner pulleys 55 may be arranged non-rotatably on a drive shaft 62 which extends continuously in the longitudinal direction of the machine.

Figure 28:
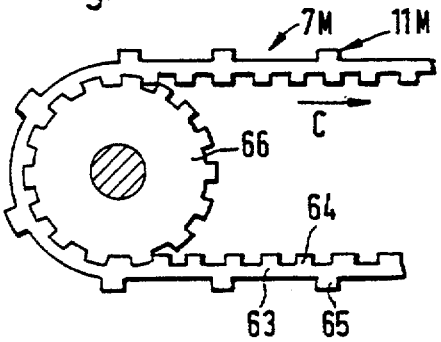
FIG. 28 is a partial view according to FIG. 25 with a differently developed driving pulley.

The construction according to FIG. 28 shows a toothed belt 63 as the guiding device 7M which has narrowly adjacent teeth 64 on one side which are used for a formlocking drive, and which, on the other side, has teeth 65 which are farther away from one another and which are used for the lateral guiding of the sliver 4. Also in the case of the toothed belt 63, a channel 57 remains between the teeth 65. In this case, a driving pulley 66 is provided which engages only in the teeth 64 so that the teeth 65 guiding the sliver 4 are not impaired by the drive.

Figure 29:
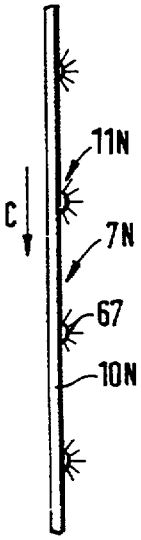
FIG. 29 is a view similar to FIG. 2 with differently developed holding elements.
Figure 27:
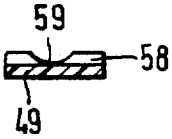
FIG. 27 is a view similar to FIG. 26 in the case of another development of the belt.
Figure 30:
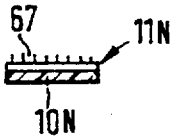
FIG. 30 is a view similar to FIG. 4 of the holding elements according to FIG. 29.

In the embodiment according to FIGS. 29 and 30, the guiding device 7N comprises a belt ION, in which case the holding elements 11N are designed as needle strips 67 which are arranged at a larger distance from one another in the transport direction C. The needles of the needle strip 67 are so short that they do not pierce the sliver completely but are used mainly for the establishment of a frictional engagement.

In the embodiment according to FIG. 31, several rows of cans 5 are again deposited on a platform 6 arranged above the spinning machine 1P. In this case, the guiding devices 7P comprise a belt 68 which is constructed as a so-called adhesive band and which again bridges a horizontal path 8P and a vertical path 9P between the cans 5 and the spinning stations 3P. In the area of the spinning stations 3P, the belt 68 is driven by a driving pulley 69 and runs along deflection pulleys 70, 71 and 72 which connect the horizontal path 8P with the vertical path 9P. The belt 68 has a fine surface structure which will be described in detail below and by which a sufficient adhesive effect is exercised particularly on the edge fibers of the sliver 4. In this case, it is advantageous for a stripping roller 74 to be provided at a suitable location, for example, directly behind the driving pulley 69 (viewed in the transport direction), after the sliver 4 has left the belt 68. In addition, it may be expedient for a pressure roller 75 to be resting against the driving pulley 69 so that the taking-along of the belt 68 is improved. If necessary, it may be useful in this case to cause a slight preliminary drafting between the roller pair formed by the driving pulley 69 and the pressure roller 75 and the drafting unit 2P. In the broadest sense, the roller pair 69, 75 is therefore already part of the drafting unit 2P.

In the horizontal path 8, the sliver 4 is covered, between the deflection pulleys 70 and 72, by means of a sheet metal strip 73 which is sufficiently heavy and "irons" the sliver 4 onto the belt 68.

The constructions according to FIGS. 32 to 46 show very different variants of adhesive bands 68. What is always involved is the obtaining of a slight adhesion for the sliver 4 on the surface of the belt 68. In these Figures, the different embodiments of the belts 68 are designated by different suffixes (e.g., 68A, 68B, etc.).

In the construction according to FIGS. 32 and 33, the belt 68 has slight specifically spaced indentations 76 which may possibly be constructed as breakthroughs. In the construction according to FIG. 34, the belt 68B, which is constructed as an adhesive band, has thin adhesion strips 77 spaced in a regular or irregular manner, in which case, under certain circumstances, these may be thin structured sheet metal strips. In the construction according to FIG. 35, only the center area 78 of the belt 68C is structured in any manner. The belt 68D according to FIG. 36 is fitted with fine points 78 in the center area. The belt 68E according to 37 has three or several fine grooves 79 in its longitudinal direction. In all cases, textile bands or possibly thin steel bands may be involved.

The belt 68F according to FIG. 38 has a V-shaped structure 80 in the manner of a herringbone pattern. This contributes to holding the sliver 4 to be transported in the center of the belt 68. Edge fibers have the tendency to shift toward the center of the belt 68F so that a denser concentration of fibers occurs because of the V-structure 80.

In the case of the belt 68G, 68H according to FIGS. 39 and 40 which is constructed as an adhesive band, it is important to provide the suitable devices for a form-locking drive. In this case, the edge of the belt 68G, according to FIG. 39, may have a perforation 81, while the belt 68H according to FIG. 40 has a lateral toothing 82.

The belt 68I according to FIG. 41 is provided with a pin structure 33. The belt 68J according to FIG. 42 contains rubber 84 which is, for example, obtained by either using a rubber-type transport belt or by applying a rubber strip. The belt 68K according to FIG. 43 is a coated steel band, in which case the coating 85 is situated in the center of the band. The construction according to FIG. 44 is a plush strip, the coating 86 of which is advantageously also situated only in the center of the belt 68L. The belt 68M according to FIG. 45 contains adhesive hairs 87 which are sloped in the transport direction C. The belt 68N according to FIG. 46 finally is constructed as an air-permeable fabric strip 88 which may possibly be subjected to suction on the side facing away from the sliver 4 so that, as a result, an adhesive effect is obtained on the sliver 4. This will be described in the following.

Figure 47:
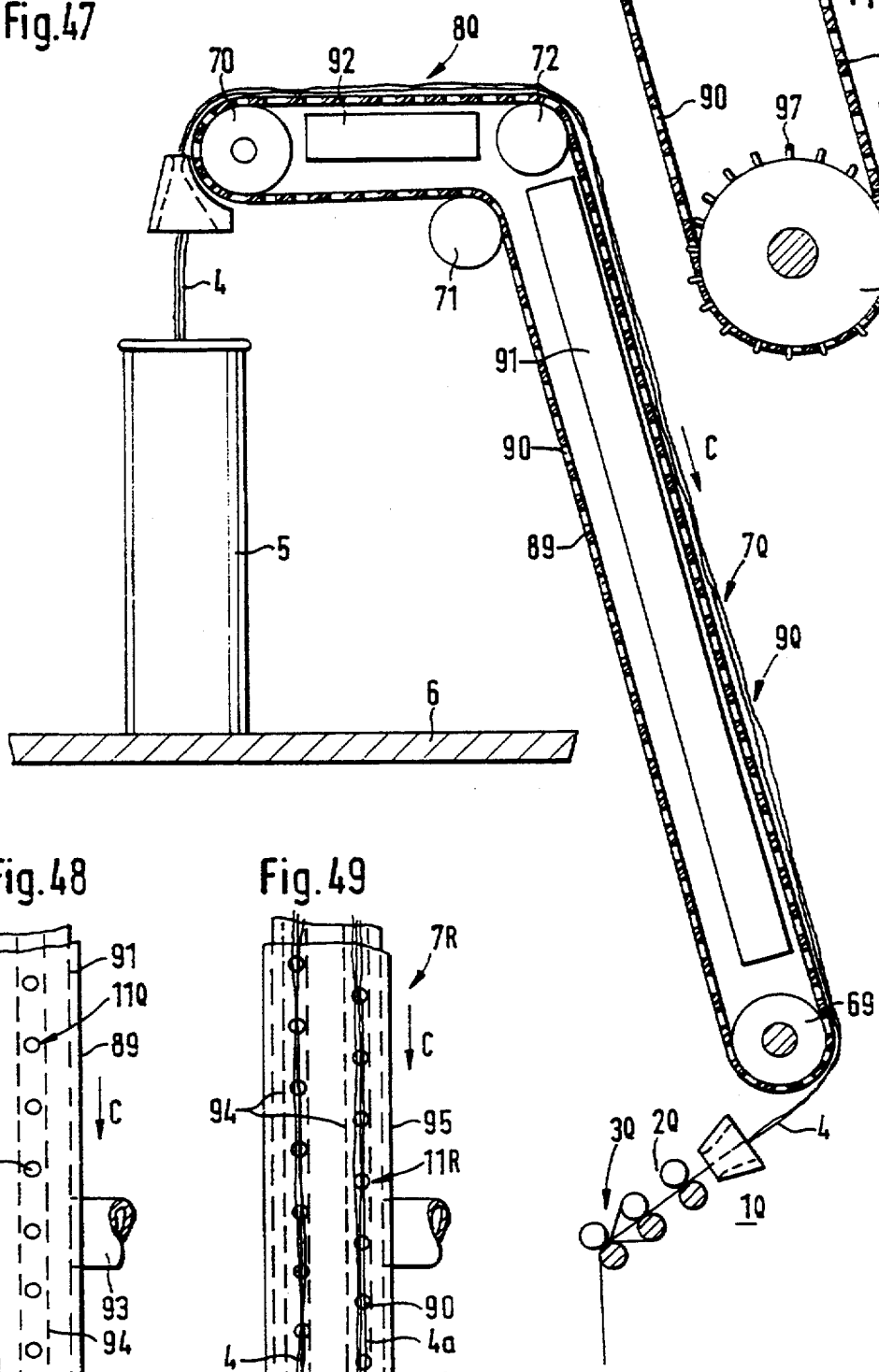
FIG. 47 is a view similar to FIG. 1 with a belt developed as a perforated band.
Figure 48:
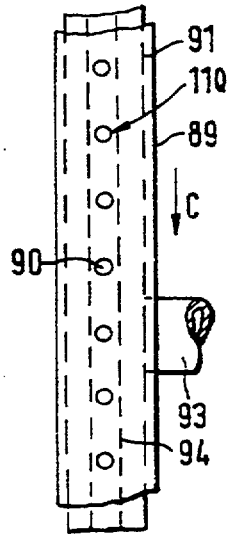
FIG. 48 is a view similar to FIG. 3 of the belt according to FIG. 47.

In the construction according to FIG. 47, the arrangement of which may be similar to that of FIG. 31, the guiding device 7Q comprises a belt 89 which is provided with a perforation 90 in the center (see also FIG. 48) which is used as the holding element 11Q. The driving pulley 69 as well as the deflection pulleys 70, 71 and 72 may be arranged in a similar manner as in FIG. 31 so that the horizontal path 8 as well as the vertical path 9 are formed by a single belt 89. Because of the perforation 90, it is possible to fasten the sliver 4 provisionally to the belt 89 by means of an air current. On the side of the belt 89 facing away from the sliver 4, suction boxes 91 and 92 are mounted which are connected to a vacuum pipe 93 and which have a longitudinal slot 94 which is aimed against the area of the perforation 90. Instead of the perforation 90, in the described manner, a fabric band 88 according to FIG. 46 may be used which is of course also air-permeable.

When, in the case of the construction according to FIG. 47, the spinning machine 1Q is switched off, the suction should, however, remain switched on, in which case, however, a very weak suction will be sufficient.

In the construction according to FIG. 47, the vertical path 9 is not arranged precisely vertically but obliquely. The less steep the vertical path of the belt 89, the less dangerous the transport of the sliver 4. A precisely vertical path has the advantage that the space requirement is the smallest. However, spinning mills exist which have large mill areas and thus do not have to save space. In such cases, a sloped arrangement of the vertical path 9Q is to be preferred. The latter will also be possible when a spinning machine 1 is involved in which the spinning stations 3Q are arranged only on one side of the machine, for example, in the case of air spinning machines. The less sloped the guiding devices 7Q, the less the requirements with respect to the adhesion of the sliver 4.

Figure 50:
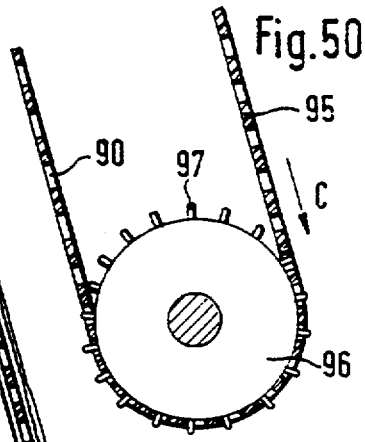
FIG. 50 is a partial view of FIG. 47 with a differently developed driving pulley.
Figure 49:
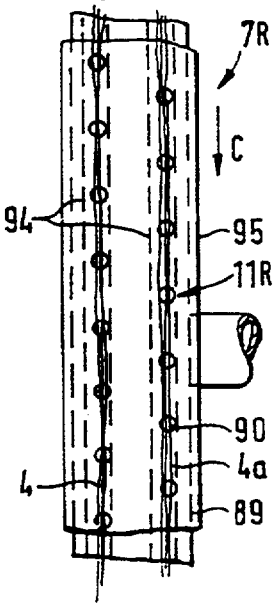
FIG. 49 is a view similar to FIG. 48 with a belt having two perforated rows for two slivers.

In FIG. 49, the guiding device 7R is a belt 95 in the case of which the holding elements 11R are developed in the form of two rows of perforations 90. As a result, it is possible to transport two parallel extending slivers 4 and **4*a* jointly by means of the same belt 95. As a result, the devices 7R for the guiding of the slivers 4, 4a require less expenditures. At the same time, the perforation 90 may be used for driving the belt 95 in a form-locking manner, as illustrated in FIG. 50. In this case, a driving pulley 96 is provided which has cams 97 and which engages in the perforation 90. Naturally, the driving pulley 96 may also be disposed at a different point, for example, where according to FIG. 23, the so-called corner pulley 55** is mounted.

In a manner which is not shown, an adhering of the sliver 4 on the guiding devices 7 may also be achieved in that the slivers 4, with specified spacing, are secured electrostatically.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning machine with a sliver conveying arrangement for conveying slivers from a sliver containing can to a drafting unit of a spinning station, said sliver conveying arrangement comprising:

a movable belt for transporting sliver thereon, said belt having an inner belt surface and an outer belt surface, said outer belt surface being a substantially continuous surface for supporting sliver, and holding elements mounted on and carried by the belt for holding the sliver without slip on the outer belt surface such that the sliver moves at a same speed as the outer belt surface to thereby prevent drafting of the sliver while the sliver is being transported, said holding elements being configured to facilitate holding of the sliver on the outer belt surface without any additional holding devices external of the belt, and without piercing said sliver.

2. A spinning machine according to claim 1, wherein the holding elements comprise surfaces which laterally secure the sliver by a frictional engagement.

3. A spinning machine according to claim 2, wherein the holding elements are constructed as sliver guides.

4. A spinning machine according to claim 2, wherein the holding elements are constructed in the shape of cams.

5. A spinning machine according to claim 4, wherein the holding elements are arranged in the shape of a serpentine path.

6. A spinning machine according to claim 4, wherein the holding elements are constructed as teeth of the movable belt, said teeth being arranged on both sides of the sliver being transported by the belt.

7. A spinning machine according to claim 2, wherein the holding elements include adhesive to secure the sliver on its supporting surface.

8. A spinning machine according to one of claim 2, comprising a sliver insertion device for the initial fastening of the sliver to the holding elements of the belt.

9. A spinning machine according to claim 1, wherein the holding elements include adhesive to secure the sliver on its supporting surface.

10. A spinning machine according to claim 9, wherein the holding elements are applied to the belt in the form of a surface mounting or structuring.

11. A spinning machine according to claim 10, wherein the belt is constructed to be air-permeable and is subjected to suction on its side opposite its sliver supporting surface.

12. A spinning machine according to claim 10, wherein the belt is provided with at least one row of perforations subjected to suction from a side of the belt which is opposite its sliver supporting surface.

13. A spinning machine according to claim 10, comprising a sliver insertion device for the initial fastening of the sliver to the holding elements of the belt.

14. A spinning machine according to claim 9, wherein the belt is constructed to be air-permeable and is subjected to suction on its side opposite its sliver supporting surface.

15. A spinning machine according to claim 14, wherein the belt is provided with at least one row of perforations subjected to suction from a side of the belt which is opposite its sliver supporting surface.

16. A spinning machine according to claim 14, comprising a sliver insertion device for the initial fastening of the sliver to the holding elements of the belt.

17. A spinning machine according to claim 9, wherein the belt is provided with at least one row of perforations subjected to suction from a side of the belt which is opposite its sliver supporting surface.

18. A spinning machine according to claim 9, comprising a sliver insertion device for the initial fastening of the sliver to the holding elements of the belt.

19. A spinning machine according to claim 9, wherein the holding elements comprise adhesion strips spaced from one another along the movable belt.

20. A spinning machine according to claim 9, wherein said movable belt includes a horizontal run section extending laterally from a position above a sliver containing can, and wherein a strip member is provided for pressing the sliver onto the horizontal run section.

21. A spinning machine according to claim 20, further comprising a stripping roller engageable with a return run section of the movable belt to strip silver therefrom.

22. A spinning machine according to claim 1, wherein the holding elements comprise clamping devices for the sliver.

23. A spinning machine according to claim 1, comprising a sliver insertion device for the initial fastening of the sliver to the holding elements of the belt.

24. A spinning machine according to claim 23, wherein said sliver insertion device includes a rotatable wheel which presses the sliver against the surface of the belt into respective holding elements on the belt.

25. A spinning machine according to claim 1, wherein said conveying arrangement includes a first substantially horizontal travel path extending from a starting position above a sliver containing can to a second position above a spinning station and a second substantially vertical path extending from the second position to a lower third position for supplying the sliver to the spinning station.

26. A spinning machine according to claim 25, wherein a first movable belt comprises said first substantially horizontal travel path and a second movable belt comprises said second substantially vertical path.

27. A spinning machine according to claim 26, wherein said first and second movable belts are endless belts having said holding elements fixed to their sliver supporting surface.

28. A spinning machine with a sliver conveying arrangement for conveying slivers from a sliver containing can to a spinning station, said sliver conveying arrangement comprising:

a movable belt for transporting sliver thereon, said belt having an inner belt surface and an outer belt surface, and outer belt surface being a substantially continuous surface for supporting sliver, and holding elements mounted on and carried by the belt for holding the sliver on the outer belt surface while the sliver is being transported, said holding elements being configured to facilitate holding of the sliver on the outer belt surface without any additional holding devices external of the belt, wherein said conveying arrangement includes a first substantially horizontal travel path extending from a starting position above a sliver containing can to a second position above a spinning station and a second substantially vertical path extending from the second position to a lower third position for supplying the sliver to the spinning station, wherein a single endless belt comprises both the substantially horizontal travel path and the substantially vertical travel path.

* * * * *